United States Patent [19]

Mochizuki et al.

[11] 4,408,964

[45] Oct. 11, 1983

[54] VANE PUMP

[75] Inventors: Norihiro Mochizuki, Inuyama; Fusayoshi Kugimiya, Minokamo, both of Japan

[73] Assignee: Kayaba Kogyo Kabushiki-Kaisha, Tokyo, Japan

[21] Appl. No.: 285,186

[22] PCT Filed: Nov. 11, 1980

[86] PCT No.: PCT/JP80/00279

§ 371 Date: Jul. 7, 1981

§ 102(e) Date: Jul. 7, 1981

[87] PCT Pub. No.: WO81/01446

PCT Pub. Date: May 28, 1981

[30] Foreign Application Priority Data

Nov. 13, 1979 [JP] Japan ..... 54-146838

[51] Int. Cl.[3] ..... F04B 49/08

[52] U.S. Cl. ..... 417/310; 418/149; 418/259

[58] Field of Search ..... 417/310; 418/259, 149

[56] References Cited

U.S. PATENT DOCUMENTS 2,856,861 10/1958 Adams et al. ..... 418/261

2,910,944 11/1959 Pettibone ..... 417/310 X 3,645,647 2/1972 Ciampa et al. ..... 417/310 X

FOREIGN PATENT DOCUMENTS 1291461 10/1972 United Kingdom .

*Primary Examiner*—Richard E. Gluck

*Attorney, Agent, or Firm*—Jordan and Hamburg

[57] ABSTRACT

A vane pump driven by an engine to serve generally as a source of hydraulic fluid pressure for operating a power steering apparatus.

A high pressure chamber (13) is formed either in a pump housing (4) or in a cover plate (6) by casting using a core. An end of the pump housing (4) or of the cover plate (6) defines a slide surface (11) with which a rotor (2) and vanes (1) are slidably and directly engaged, thus being formed with delivery ports (12) or suction ports (29). This precludes the need of a side plate, a spring for biasing the side plate against the rotor, and others which have hitherto been indispensable for a vane pump, so that the total number of components parts is reduced.

A cam ring (5) is sandwiched between the pump housing (4) and cover plate (6) and locked together to the pump housing (4). This makes it needless to form a bore in the pump housing (4) for accommodating a cam ring and thereby enhances the machinability of such a pump.

2 Claims, 10 Drawing Figures

VANE PUMP

DESCRIPTION

1. Technical Field

This invention relates to a vane pump which is suitable to serve as a source of hydraulic fluid pressure for a power steering system of a motor vehicle.

Generally, a vane pump of the type described is driven by an engine mounted on a motor vehicle to delivery a hydraulic fluid under pressure for operating a power cylinder which is adapted to assist the operator of the motor vehicle in manipulating the steering wheel. Such a vane pump is furnished with a flow control valve to supply the power cylinder with a substantially constant amount of pressurized fluid.

2. Background Art

In a vane pump, a flow control valve is located in a position where the suction and delivery ports of the pump are gathered so that the valve may bypass an excessive part of the discharged hydraulic fluid back to the suction port and thereby control the delivery from the pump to a load to a predetermined value.

For this purpose, a side plate is provided to define within a pump housing a high pressure chamber which permits the independent flows of high pressure fluid from two outlet ports of the pump to join each other and advance therefrom to the flow control valve. The two outlet ports are located in symmetrical relation with respect to a drive shaft of the pump.

The side plate is received in a bore of the pump housing while O-rings are employed to seal the outer periphery of the side plate and that portion of the side plate through which the pump shaft extends, respectively.

Together with the side plate, a cam ring is accommodated in the pump housing and covered by a cover plate at the other end thereof.

A rotor having vanes thereon is disposed in the cam ring to be driven by the pump shaft for rotation.

The cam ring whose width is the same as the width of a vane must be held under a moderate pressure between the side plate and cover plate so as to prevent the fluid from leaking at the opposite lateral ends of the vanes with respect to the direction of rotation of the vanes.

To meet this requirement, the side plate is constantly biased by a spring against the cam ring from the high pressure chamber side inside the pump housing. The cam ring is thus held between the spring biased side plate and the cover plate which is bolted to the pump housing.

The prior art vane pump having the above construction involves various problems as will be described. First, an additional number of parts are necessary for the vane pump because the high pressure chamber is defined by the pump housing and side plate.

Second, the pump housing requires intricate machining to haver thereinside the high pessure chamber and the relatively large bore adapted to receive the side plate and cam ring.

Third, a spring must be installed in the vane pump to exert a strong pressure force on the side plate so that the assembly remains liquid-tight particularly at a start of operation of the pump. This spring does not function in any way once the pump starts its operation because the high fluid pressure which will build up thereafter can be utilized for the same function.

It is an object of the present invention to provide a vane pump which is small in the number of necessary parts, compact in design and economical to produce.

It is another object of the present invention to provide a vane pump which achieves improved machinability by making the bore inside the pump housing needless.

DISCLOSURE OF INVENTION

According to the invention, either a pump housing or a cover plate is formed with a high pressure chamber by casting with a core. That end of the pump housing or of the cover plate formed with the high pressure chamber constitutes a surface with which a rotor and vanes carried thereon are directly and slidably engaged. Outlet or inlet ports are formed on said specific slide surface of the pump housing or of the cover plate. This makes the construction simple and therefore cuts down the production cost due to the omission of various component parts such as the side plate, spring and oil seals.

A cam ring is placed between the pump housing and cover plate and locked together by suitable fastening means such as bolts. This unnecessitates the presence of the bore which would otherwise be needed in the pump housing to accommodate the cam ring and the like, improving the machinability of a vane pump.

BRIEF DESCRIPTION OF DRAWINGS

FIGS. 1–7 illustrate a preferred embodiment of a vane pump according to the present invention, in which FIG. 1 is a sectional side elevation, FIG. 2 an exploded perspective view, FIG. 3 is a perspective view of a core which will be used to form a high pressure chamber by casting, FIG. 4 a rear view of a cover plate, FIG. 5 a front view of a cam ring, FIG. 6 a rear view of the cam ring, and FIG. 7 a front view of a pump housing; and FIGS. 8–10 illustrate another preferred embodiment of the vane pump according to the present invention, in which FIG. 8 is a sectional side elevation, FIG. 9 an exploded perspective view, and FIG. 10 a perspective view of a core which will be used to form a high pressure chamber by casting.

BEST MODE FOR CARRYING OUT THE INVENTION

The invention will be discussed in detail below with reference to the accompanying drawings.

Referring to FIGS. 1–7, a preferred embodiment of the vane pump according to the present invention is illustrated.

Figure 1:
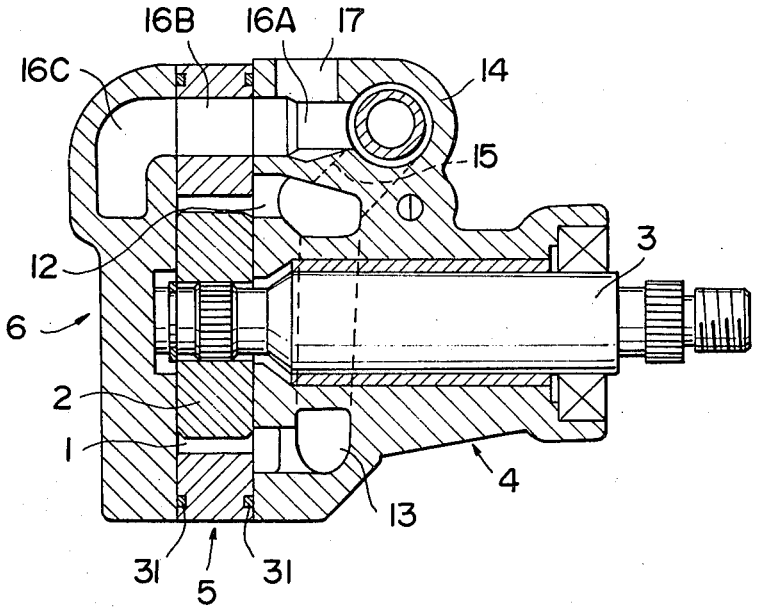
Figure 2:
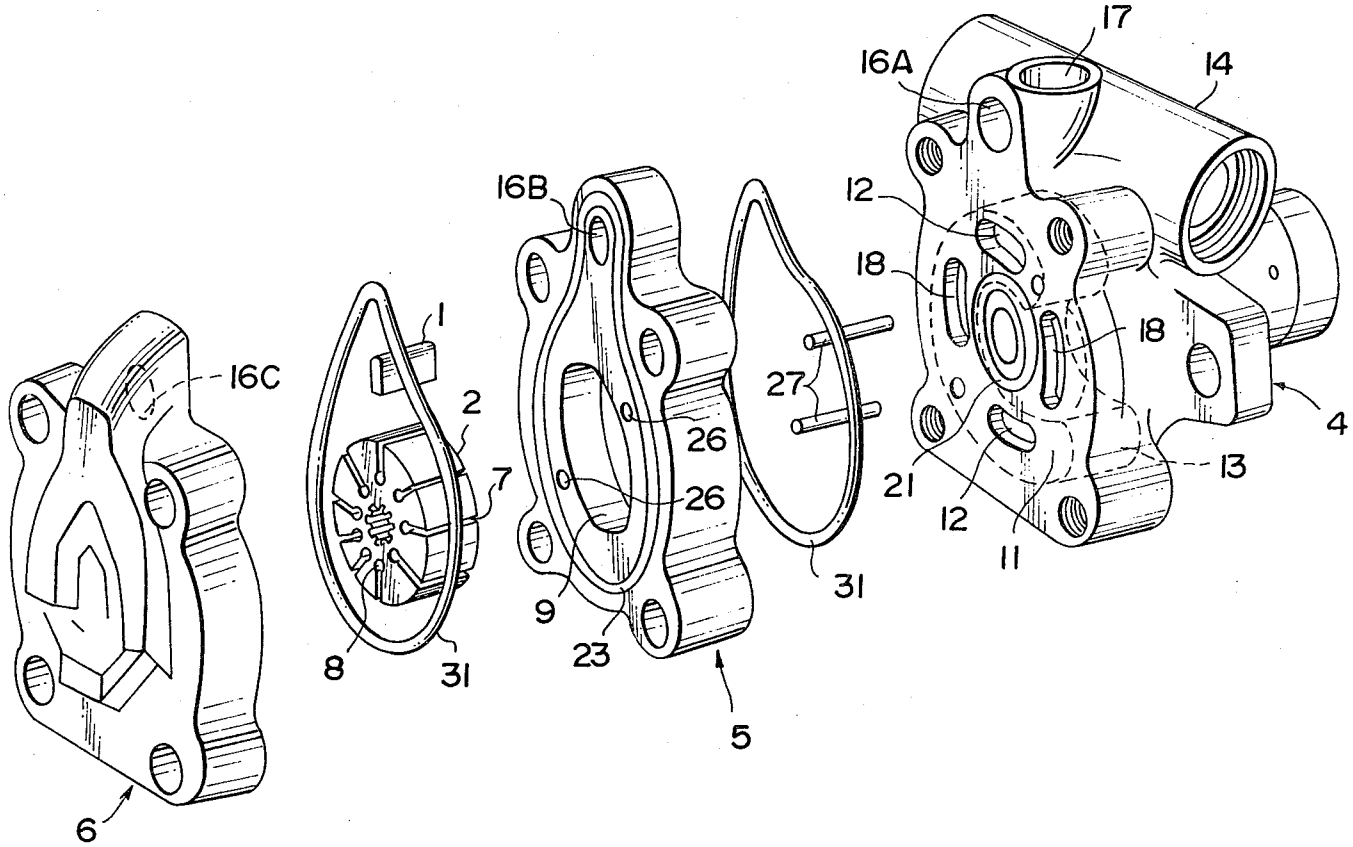

As shown in FIGS. 1 and 2, the vane pump principally comprises a rotor 2 having vanes 1 therewith, a pump shaft 3 for driving the rotor 2 for rotation, a pump housing 4 by which the pump shaft 3 is supported rotatably, a cam ring 5 surrounding the rotor 2, and a cover plate 6 locked to the pump housing 4 by suitable fastening means such as bolts with the cam ring 5 and rotor 2 held therebetween.

As viewed in FIG. 2, the vanes 1 (only one is shown in FIG. 2) are received radially movably in radial slots 7 which are formed in the rotor 2 as usual. The vanes 1 are constantly urged against a cam surface 9 of the cam ring 5 by the delivery pressure of the pump which is communicated to the radially innermost portions 8 of the slots 7 and centrifugal forces resulting from the rotation of the rotor 2.

Figure 5:
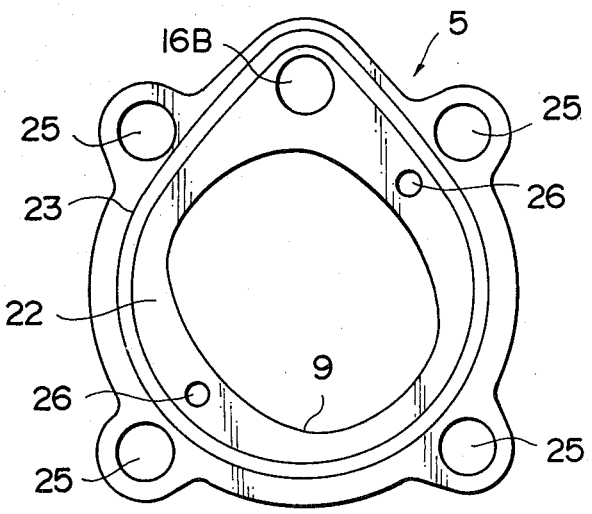

The cam surface 9 defines a substantially oval space thereinside as indicated in FIG. 5. While the rotor 2 is rotating with the vanes 1 pressed against the oval cam surface 9, a working chamber defined by two adjacent vanes, rotor 2 and cam surface 9 undergoes an increase (suction stroke) and a decrease (delivery stroke) in volume each by two times for one full rotation of the rotor 2.

The pump housing 4 is formed with outlet ports 12 on that surface 11 with which the vanes 1 are slidably engaged and in predetermined positions where each working chamber defined as described performs delivery strokes.

The pump housing 4 has thereinside a high pressure chamber 13 formed by casting with a core; the chamber 13 is in fluid communication with the outlet ports 12. Also formed in the pump housing 4 is a substantially cylindrical valve housing section 14 adapted to receive a flow control valve (not shown) thereinside. The high pressure chamber 13 is connected by a passageway 15 with the inlet side of the flow control valve. The excess fluid return side of the flow control valve is connected with inlet ports, which will be described, by a passageway 16A. A suction port 17 for hydraulic connection of the pump to a tank or reservoir (not shown) is communicated with the passageway 16A. All these passageways 15 and 16A and suction port 17 are also formed in the pump housing 4.

Figure 3:
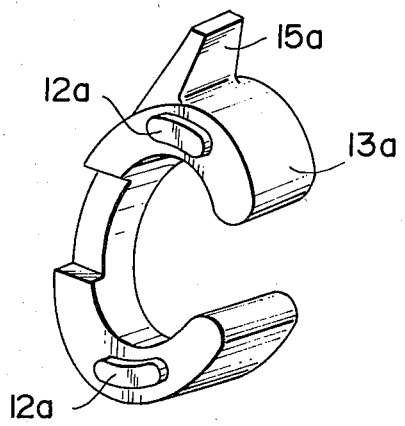

FIG. 3 indicates a core which will be used to form the outlet ports 12, high pressure chamber 13 and passageway 15 in the pump housing 4 by casting. As shown, the core has an arcuate body portion 13*a* to form the high pressure chamber 13, a lug 15*a* extending radially from the body portion 13*a* to form the passageway 15, and a pair of lugs 12*a* on an end of the body portion 13*a* to form the outlet ports 12, respectively.

The slide surface 11 of the pump housing 4 is formed with recesses 18 which face the inlet ports, and an annular recess or groove 21 which has communication with the high pressure chamber 13 through radially formed drilled holes 19. The annular groove 21 functions to distribute the hydraulic fluid force transmitted thereto from the high pressure chamber 13 into the radially innermost portions 8 of the slots 7 of the rotor 2 so that the vanes 1 will be urged against the cam surface 9 of the cam ring 5 in the manner already discussed.

As shown in FIG. 5, the cam ring 5 has a contour which is substantially common to that of the pump housing 4 or of a cover plate 6, which will be described, as seen in a front view.

In addition to the aforesaid cam surface 9, the cam ring 5 has a passageway 16B which extends therethroughout to be aligned with the passageway 16A of the pump housing 4.

Shown in FIG. 5 is that surface 22 of the cam ring 5 which will be engaged by the cover plate 6. This engagement surface 22 is formed with an annular sealing recess or groove 23 which encloses the passageway 16B and cam surface 9 thereinside.

Figure 6:
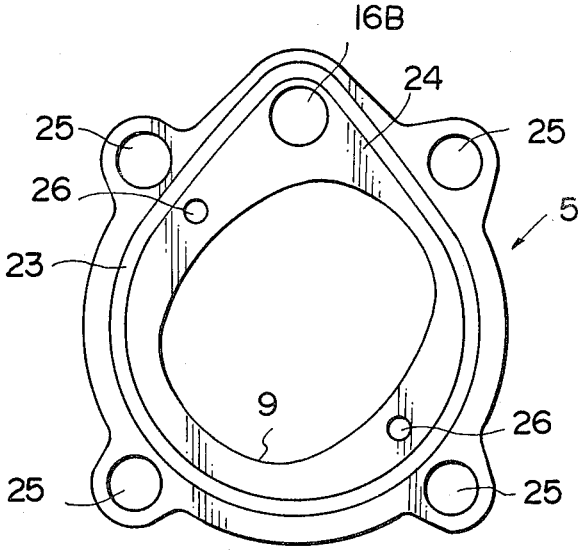
Figure 7:
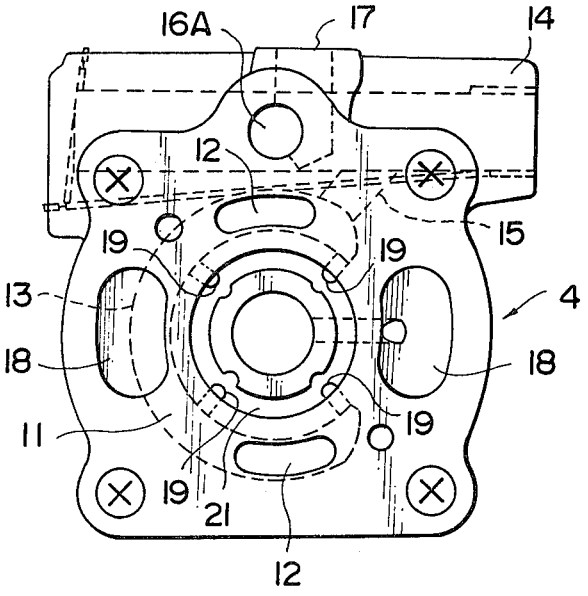

FIG. 6 indicates the other surface 24 of the cam ring 5 which will be engaged by the pump housing 4. This engagement surface 24 is also formed with an annular sealing recess or groove 23 which is similar to the sealing groove 23 on the engagement surface 22. As seen in FIGS. 5 and 6, holes 25 are drilled in the cam ring 5 to pass bolts therethrough when the cover plate 6, cam ring 4 and pump housing 4 are to be bolted together with the cam ring 5 sandwitched between them. Holes 26 are additionally formed in the cam ring 5 so that knock pins 27 (see FIG. 2) may be passed therethrough to properly position the cam ring 5 relative to the pump housing 4 and cover plate 6.

Figure 4:
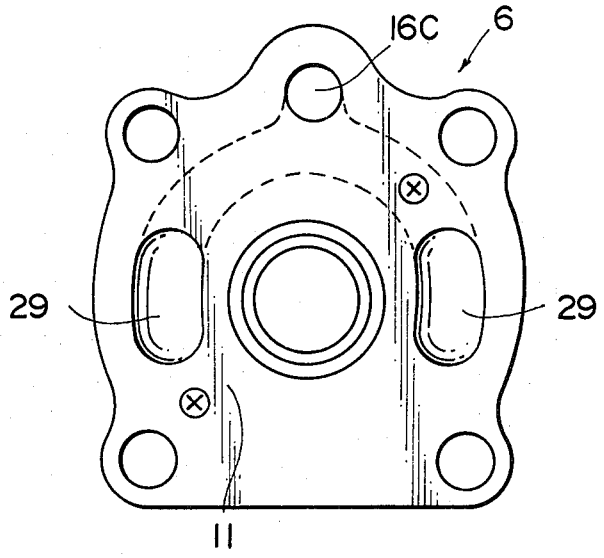

As also shown in FIG. 4, the cover plate 6 is formed with inlet ports 29 on a surface 11 thereof with which the vanes 1 on the rotor 2 are slidably engaged and in positions where they will communicate with specific working chambers in suction stroke. A passageway 16C is formed in the cover plate 6 to be communicated with the passageway 16B in the cam ring 5. The passageway 16C is gently bifurcated within the cover plate 6 such that the individual ends of the bifurcated portion open at the slide surface 11 of the cover plate 6 as the inlet ports 29, respectively.

As stated hereinbefore, the cover plate 6 is locked to the pump housing 4 by bolts (not shown) holding the rotor 2 with vanes 1 and the cam ring 5 therebetween. As seen in FIG. 2, the cam ring 5 is clamped tight between the cover plate 6 and pump housing 4 with oil seals (O-rings) 31 received in the individual sealing grooves 23 on the cam ring 5.

The vane pump having the above construction and arrangement will be operated as follows.

A working chamber is defined by the opposing slide surfaces 11 of the pump housing 4 and cover plate 6 in addition to the adjacent vanes 1, rotor 2 and cam surface 9 of the cam ring. As the pump shaft 3 is rotated to drive the rotor 2 for rotation, the working chamber repeatedly performs a delivery stroke and a suction stroke in the manner already defined.

Pressurized hydraulic fluid forced out of the working chamber during a delivery stroke is admitted into the high pressure chamber 13 of the pump housing through an outlet port 12 and then into the flow control valve via the passageway 15.

The flow control valve, as well known to the art, supplies a load with only the pressurized fluid controlled to a predetermined flow rate while releasing the excess fluid to the passageway 16A.

This part of the fluid released to the passageway 16A flows through the intercommunicated passageways 16B and 16C and, in the course of this movement, it joins a fresh supply of fluid which is fed from the tank or reservoir (not shown) via the suction port 17. It is noteworthy here that the suction port 17 is open at a position where the velocity of the fluid flow returned from the flow control valve is the highest and the pressure is the lowest. This affords the so-called supercharging effect with the maximum efficiency so that the fresh flow of fluid from the reservoir can advance positively from the suction port 17 into the passageway 16A or 16B.

The combined fluid flow at the passageway 16A or 16B moves therefrom to the inlet ports 29 by way of the passageway 16C. At this instant, the velocity energy of the fluid flow is partly transformed into a pressure energy which causes the fluid to flow into working chambers in suction stroke efficiently through the inlet port 29.

It will be seen that the two oil seals 31 serve to keep working chambers and passageways 16A–16C fully liquid-tight during suction and delivery strokes.

Figure 8:
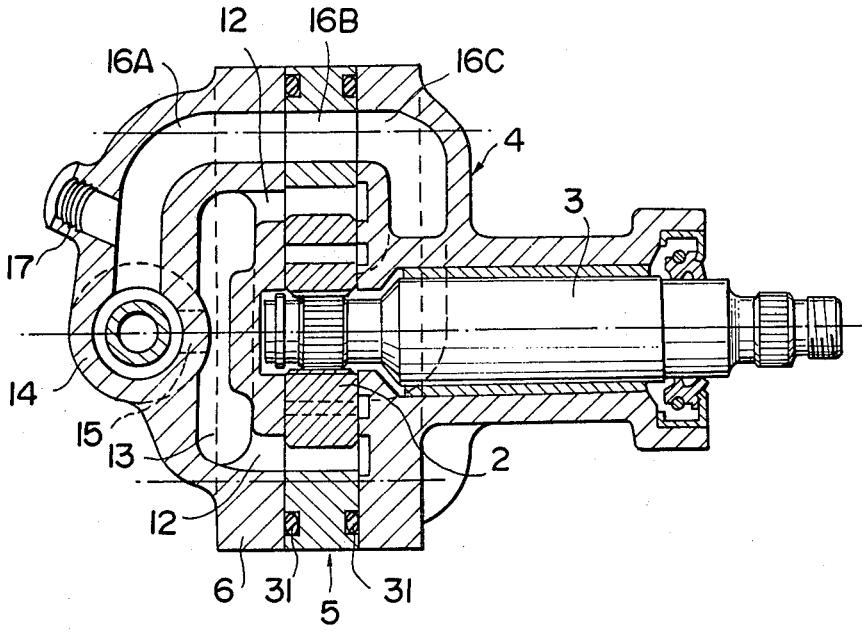
Figure 10:
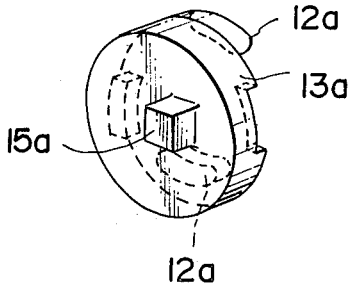
Figure 9:
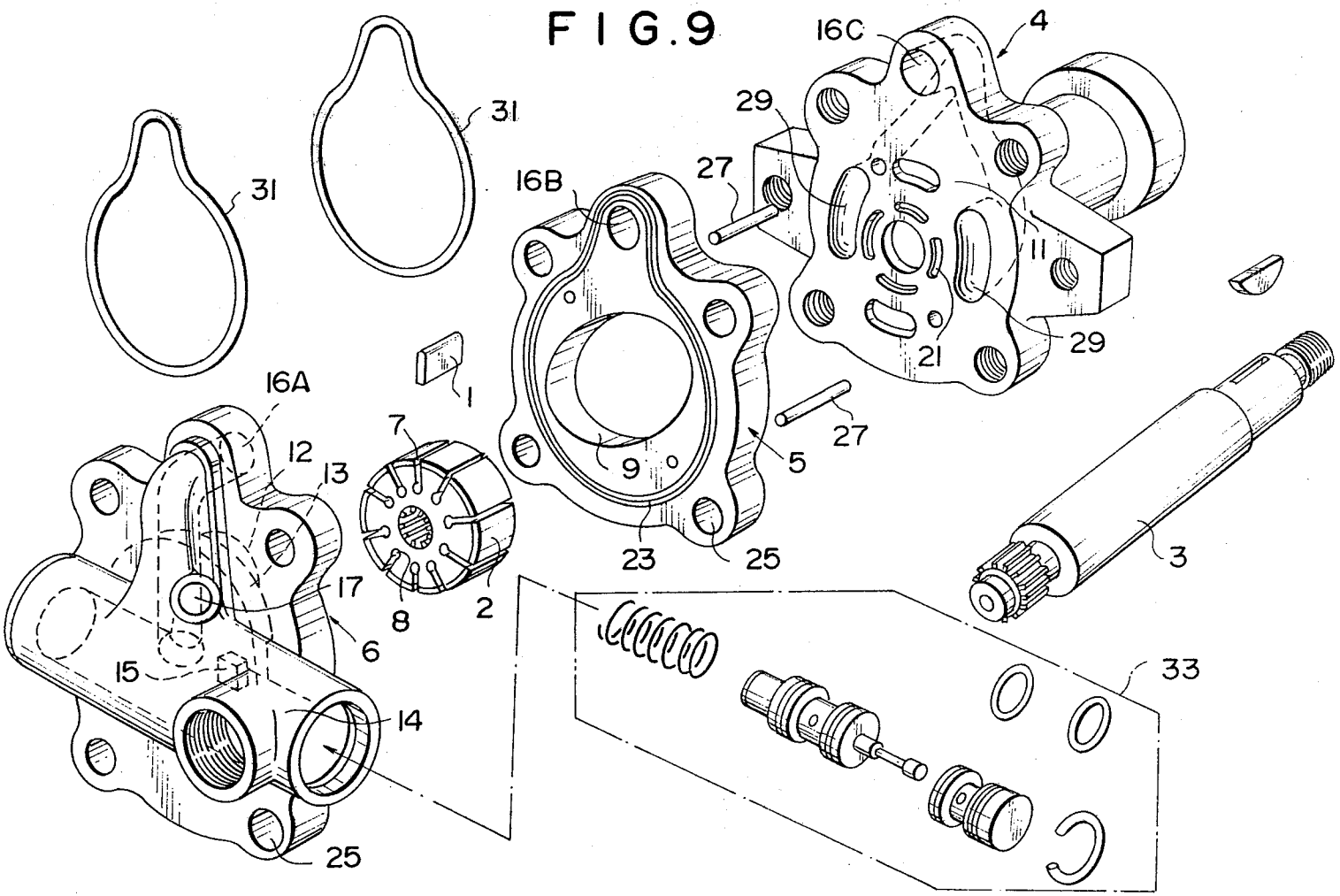

Another preferred embodiment of the vane pump according to the invention is illustrated in FIGS. 8–10.

In this vane pump, a passageway 16C and inlet ports 29 are formed in a pump housing 4 which is adapted to support the pump shaft 3 rotatably whereas outlet ports 12, a high pressure chamber 13, a valve housing 14, passageways 15 and 16A, suction port 17 and the like are formed in a cover plate 6 which is locked to the pump housing 4 with the intermediary of a vaned rotor 2.

FIG. 10 shows in perspective a core for defining the high pressure chamber 13 and others within the cover plate 6 by casting. The core has a generally disc-shaped body portion 13*a* to form the high pressure chamber 13, a lug 15*a* extending from a substantially central area of the front end of the body portion 13*a* to form the passageway 15, and upper and lower lugs 12*a* positioned on the back of the body portion 13*a* to form the delivery ports 12.

The reference numeral 33 in FIG. 9 designates a known flow control valve which is received in a valve housing which forms a part of the cover plate 6 this time.

The other portions of the construction and arrangement according to the second embodiment are common to those of the first embodiment described with reference to FIGS. 1–7 and, therefore, they will not be described any further herein with the same reference numerals employed in the drawings to denote essentially the same parts and elements.

As clearly shown in FIG. 9, the flow control valve 33 of the second embodiment is located in front of the pump shaft 3. Such a location of the valve will prove effective, where a power steering apparatus is positioned in opposing relation with the drive system for the pump shaft 3, to shorten the necessary fluid tubing between the flow control valve 33 and power steering apparatus (power cylinder) and thereby facilitate easy piping work while minimizing the liability of failures.

We claim:

1. A vane pump comprising a rotor (2) which has a plurality of vanes (1) arranged radially thereon and driven for rotation by a pump shaft (3), a cam ring (5) having a cam surface (9), said cam ring (5) accommodating said rotor (2) thereinside to permit said vanes (1) to remain in slidable engagement with said cam surface (9), a pump housing (4) having an inlet and an outlet, said pump housing (4) rotatably supporting a pump shaft (3) and having a slide surface (11) which is engaged with one end face of said cam ring (5) and the corresponding end face of said rotor (2), a cover plate (6) having a slide surface (11) which is engaged with the other end face of said cam ring (5) and the corresponding end face of said rotor (2), fastening means for locking said pump housing (4), cover plate (6) and cam ring (5) together with said cam ring (5) held between said pump housing (4) and said cover plate (6), said pump housing (4) being formed with a valve chamber (14) adapted to receive a flow control valve to control outlet flow, said pump housing (4) having a pressure chamber (13) which communicates with said valve chamber (14), said slide surface (11) of said cover plate (6) being formed with a pair of inlet ports (29), said cover plate (6) having a bifurcated passageway (16C) terminating at said inlet ports (29), said pump housing (4) having an excess return passageway (16A) at an excess fluie return side of said pump housing (4), said cam ring (5) being formed with a cam ring passageway (16B) providing fluid communication between said bifurcated passageway (16C) and said excess return passageway (16A), said pump housing (4) having a suction port (17) which communicates with said excess return passageway (16A), said suction port (17) being adapted to be connected to a reservoir, said suction port (17) being disposed adjacent to said valve chamber (14), said cam ring (5) having engagement surfaces (22, 24) engaging said slide surfaces (11) of said pump housing (4) and said cover plate (6), and a seal ring (31) on each of said engagement surfaces (22,24), said seal rings (31) extending around said cam surface (9) and partially around the outer periphery of said cam ring passageway (16B), whereby said cam ring passageway (16B) and said cam surface (9) are enclosed with said seal rings (31).

2. A vane pump comprising a rotor (2) which has a plurality of vanes (1) arranged radially thereon and driven for rotation by a pump shaft (3), a cam ring (5) having a cam surface (9), said cam ring (5) accommodating said rotor (2) thereinside to permit said vanes (1) to remain in slidable engagement with said cam surface (9), a pump housing (4) rotatably supporting a pump shaft (3) and having a slide surface (11) which is engaged with one end face of said cam ring (5) and the corresponding end face of said rotor (2), a cover plate (6) having an inlet and an outlet and also having a slide surface (11) which is engaged with the other end face of said cam ring (5) and the corresponding end face of said rotor (2), fastening means for locking said pump housing (4), cover plate (6) and cam ring (5) together with said cam ring (5) held between said pump housing (4) and said cover plate (6), said cover plate (6) being formed with a valve chamber (14) adapted to receive a flow control valve to control outlet flow, said cover plate (6) having a pressure chamber (13) which communicates with said valve chamber (14), said slide surface (11) of said pump housing (4) being formed with a pair of inlet ports (29), said pump housing (4) having a bifurcated passageway (16C) terminating at said inlet ports (29), said cover plate (6) having an excess return passageway (16A) at an excess fluid return side of said cover plate (6), said cam ring (5) being formed with a cam ring passageway (16B) providing fluid communication between said bifurcated passageway (16C) and said excess return passageway (16A), said cover plate (6) having a suction port (17) which communicates with said excess return passageway (16A), said suction port (17) being adapted to be connected to a reservoir, said suction port (17) being disposed adjacent to said valve chamber (14), said cam ring (5) having engagement surfaces (22,24) engaging said slide surfaces (11) of said pump housing (4) and said cover plate (6), and a seal ring (31) on each of said engagement surfaces (22,24), said seal rings (31) extending around said cam surface (9) and partially around the outer periphery of said cam ring passageway (16B), whereby said cam ring passageway (16B) and said cam surface (9) are enclosed within said seal ring (31).

* * * * *